US005911592A

United States Patent [19]

Lew et al.

[11] Patent Number: 5,911,592

[45] Date of Patent: Jun. 15, 1999

[54] PRINTED CIRCUIT BOARD ASSEMBLY

[75] Inventors: Yaron Lew, New Haven; Eric B. Westphal, Norwalk, both of Conn.

[73] Assignee: Framatome Connectors USA Inc., Fairfield, Conn.

[21] Appl. No.: 09/004,417

[22] Filed: Jan. 8, 1998

[51] Int. Cl.[6] ..... H01R 4/24

[52] U.S. Cl. ..... 439/383; 439/354

[58] Field of Search ..... 439/353, 354, 439/383, 352

[56] References Cited

U.S. PATENT DOCUMENTS 5,562,477 10/1996 Moore et al. ..... 439/383

*Primary Examiner*—Neil Abrams
*Assistant Examiner*—Barry M. L. Standig
*Attorney, Agent, or Firm*—Perman & Green, LLP

[57] ABSTRACT

A printed circuit board assembly comprising a printed circuit board, a first connector, a second connector and a vibration damper. The first connector is mounted directly to the printed circuit board. The second connector is removably connected to the first connector. The vibration damper is located between the first and second connectors. The vibration damper comprises the second connector having a pair of stabilizers located on opposite sides of the first connector. The vibration damper also comprises a shim block that is removably attached to the first connector. The shim block is sandwiched between a first one of the pair of stabilizers and the first connector. This provides a friction connection between the first connector and the pair of stabilizers on the second connector.

22 Claims, 3 Drawing Sheets

PRINTED CIRCUIT BOARD ASSEMBLY

BACKGROUND OF THE INVENTION

1. Field of the Invention

The present invention relates to a printed circuit board assembly and, more particularly, to a printed circuit board assembly with a vibration damper between connectors of the assembly.

2. Prior Art

Printed circuit board assemblies are well known in the art. This includes printed circuit board assemblies having a printed circuit board with a first connector mounted directly thereto and a second connector removably connected to the first connector. In the prior art the stability of the connection between the first and second connectors is provided by the direct interface between surfaces of the two connectors. However, clearances provided to facilitate ease of installation of the second connector on the first connector render the mechanical connection between the connectors susceptible to vibratory motions that arise typically during shipping of the printed circuit board assembly. These vibratory motions have a detrimental effect on the electrical connection between the connectors. The present invention overcomes this problem by providing a vibration damper between the first and second connectors to eliminate or at least significantly reduce or dampen vibratory motion therebetween.

SUMMARY OF THE INVENTION

In accordance with one embodiment of the present invention, a printed circuit board assembly is provided comprising a printed circuit board, a first connector, a second connector and a vibration damper. The first connector is mounted directly to the printed circuit board. The second connector is removably connected to the first connector. The vibration damper is between the first and second connectors. The second connector has a pair of stabilizers located on opposite sides of the first connector. The vibration damper comprises a shim block that is removably attached to the first connector. The shim block is sandwiched between a first one of the pair or stabilizers of the second connector and the first connector. This provides a friction connection between the first connector and the pair of stabilizers on the second connector.

In accordance with another embodiment of the present invention, a printed circuit board assembly is provided comprising a printed circuit board, a first connector, a second connector, and a support block. The first connector is mounted directly to the printed circuit board. The second connector is removably connected to the first connector. The second connector has a pair of guides projecting towards a front of the second connector. The pair of guides are located on opposite sides of the first connector when the second connector is connected to the first connector. The support block is attached to the first connector between the first connector and second connector so that a support surface of the support block contacts a first one of the pair of guides. The support surface of the support block has a spring loaded portion located in the first one of the pair of guides.

In accordance with yet another embodiment of the present invention, a printed circuit board assembly is provided comprising a printed circuit board, a first connector, a second connector and a connector retainer. The first connector is mounted directly to the printed circuit board. The second connector is removably mounted to the first connector. The connector retainer is removably attached to the first connector between the first and second connectors. The connector retainer has a general block shape with a lower seating surface seated on an upper side of the first connector. The connector retainer has a pair of tangs projecting from opposite sides of the block shape into the first connector.

In accordance with one method of the present invention, a method for connecting to a printed circuit board assembly is provided. The method comprises the steps of providing a printed circuit board assembly, attaching a vibration reducer on the printed circuit board assembly and removably connecting a connector to the printed circuit board assembly. The printed circuit board assembly has a printed circuit board and a first connector mounted directly thereto. The vibration reducer is attached to the first connector. The vibration reducer has a general block shape adapted to be admitted between a pair of guides projecting from a first side of the first connector. A second connector is removably connected to the first connector. The second connector has a pair of cantilevered stabilizers located astride the first connector. A first one of the pair of stabilizers is in contact with the pair of guides on the first connector sandwiching the vibration reducer therebetween to form a friction connection between the first connector and second connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
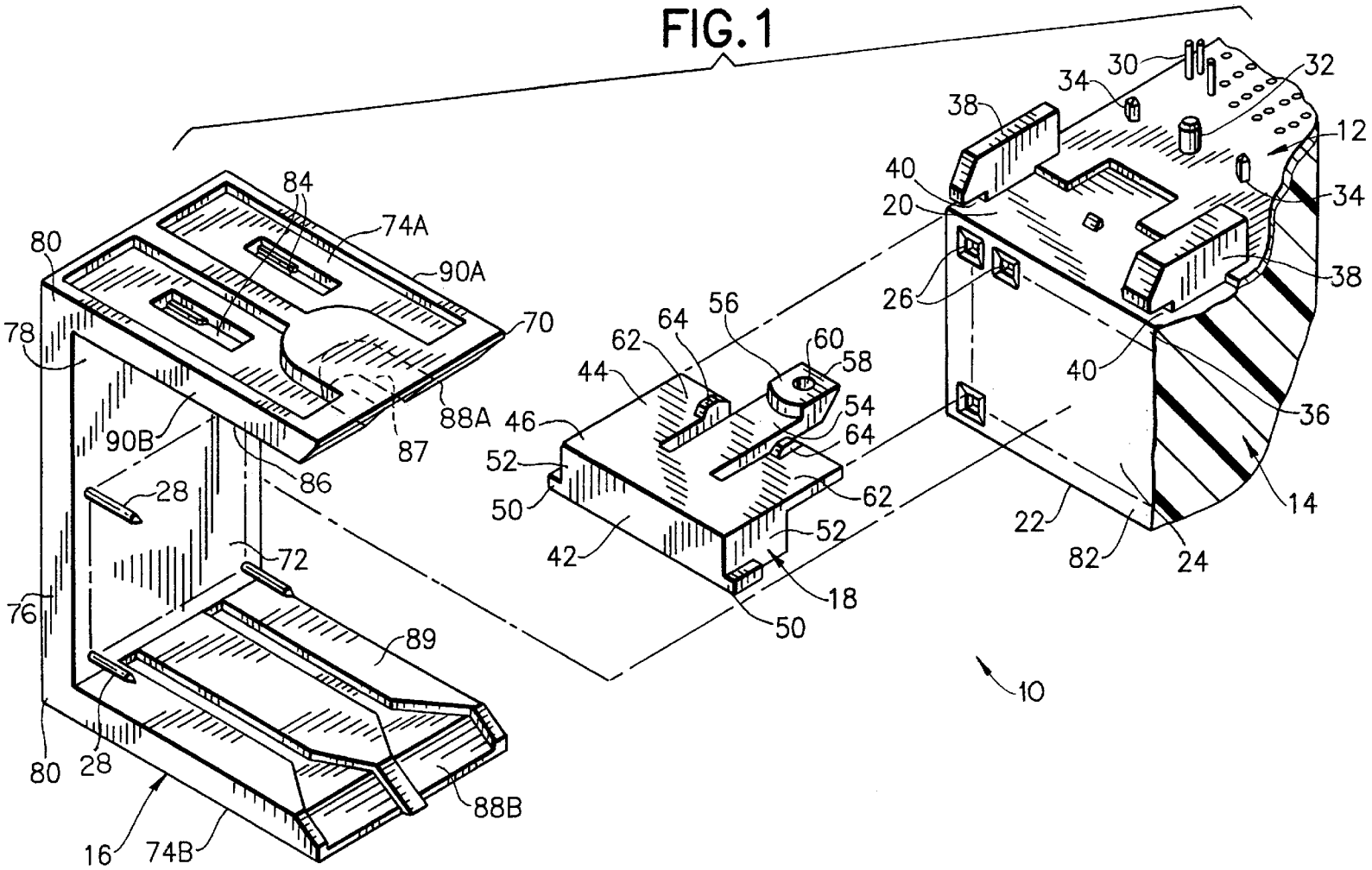
FIG. 1 is an exploded partial perspective view of a printed circuit board assembly incorporating features of the present invention.

Referring to FIG. 1, there is shown an exploded partial perspective view of a printed circuit board assembly 10 incorporating features of the present invention. Although the present invention will be described with reference to the embodiments shown in the drawings, it should be understood that the present invention may be incorporated into various different alternate embodiments and different types of printed circuit board assemblies. In addition, any suitable size, shape or type of elements or materials could be used.

The printed circuit board assembly 10 generally comprises a printed circuit board 12, a first connector 14, a second connector 16, and a vibration damper 18. The first connector 14 is mounted directly to the printed circuit board 12. The second connector 16 is removably connected to the first connector 14. The vibration damper 18 is attached to the first connector 14 between the first connector 14 and a portion of the second connector 16. FIG. 1 shows only portions of the first and second connectors sufficient to demonstrate the features of the present invention. The lateral length of the first connector 14 can vary. Any suitable number of second connectors 16 can be provided to attach to that length, such as four or more. The features of the present invention disclosed herein may be repeated as required for each second connector.

The printed circuit board 12 could be any suitable type of board. In an alternate embodiment, the first connector 14 could be attached to a different type of electrical component rather than a printed circuit board. The first connector 14 has an upper surface 20, a lower surface 22 and a rear electrical interface surface 24. The terms "upper", "lower", "rear" and "front" are used for reference purposes only. The rear electrical interface surface 24 has a series of ports 26 to admit male contacts 28 on the second connector 16. In alternate embodiments, the first connector may be a connector with male contacts projecting from the rear interface to be received in ports of the second connector. In the preferred embodiment, tails 30 of contacts in the first connector 14 extend from its upper surface 20 into holes of the printed circuit board 12. In alternate embodiments the tails of contacts in the first connector may extend from the lower surface or from a front end of the connector. The upper surface 20 has a post 32 and anchors 34 projecting therefrom. The post 32 and anchors 34 are aligned generally in a row proximate the contact tails 30. Guide rails 38 extend from the upper surface 20 proximate the rear end 36 of the connector 14. Each guide rail 38 has a groove 40 formed therein. The first connector 14 is mounted directly to the printed circuit board 12 with the upper surface 20 against the printed circuit board 12. The contact tails 30 are through-hole mounted to the printed circuit board 12 as is known in the art. The post 32 and anchors 34 of the connector 14 are received in locating holes in the printed circuit board 12 to fix the connector 14 to the printed circuit board 12.

Figure 2:
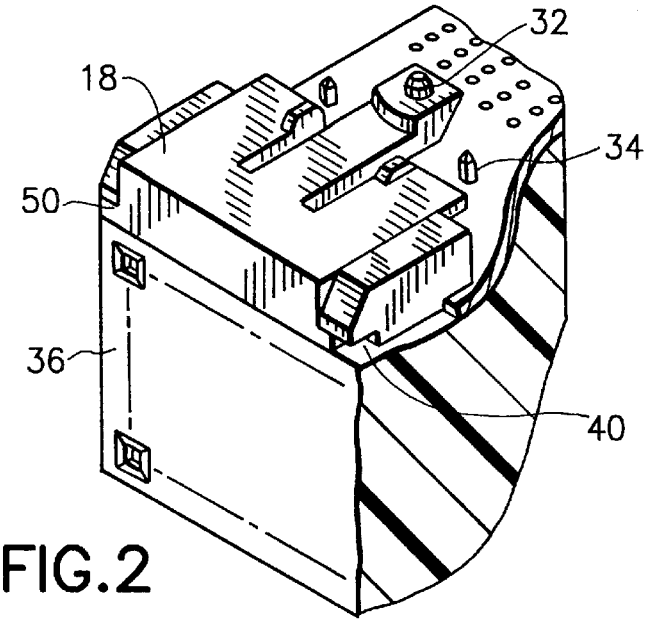
FIG. 2 is a partial perspective view of one of the connectors and the vibration damper shown in FIG. 1.
Figure 3:
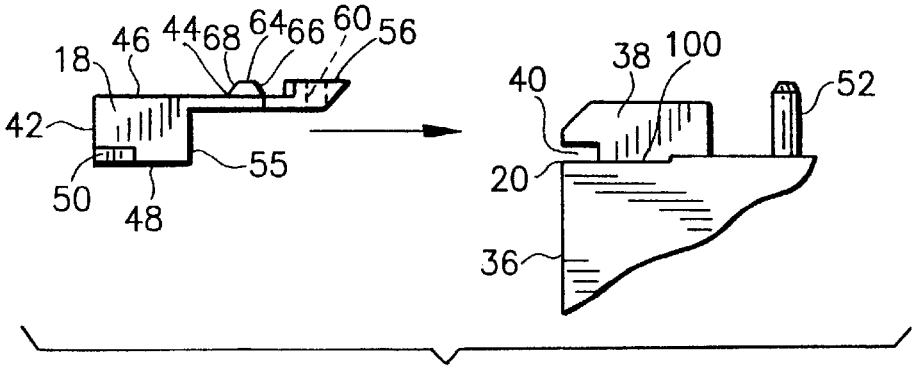
FIG. 3 is an exploded partial side elevation view of the connector and vibration damper shown in FIG. 2.

Referring now to FIGS. 1–3, the vibration damper 18 is preferably a one-piece member made from a dielectric material. The vibration damper 18 comprises a general block shaped section 42 and a spring section 44 extending forward from the block shaped section 42. The block shaped section 42 has an upper seating surface 46 and a lower seating surface 48. The block shaped section 42 has a pair of tongues 50 projecting from the opposite sides 52 of the block section 42. The tongues 50 conform to the grooves 40 in the guide rails 38 of the first connector 14. A restraint arm 54 is cantilevered from the front face 55 of the block section. The restraint arm 54 has a boss section 56 at the forward end 58 with a hole 60 therein. The hole 60 is adapted to receive a top end of the post 32 on the first connector 14. The spring section 44 comprises two cantilevers 62 extending from the front face 55 of the block shaped section 42. The cantilevers 62 are located on opposite sides of the restraint arm 54. The cantilevers 62 are substantially flush with the upper seating surface 46 of the vibration damper 18. Each cantilever 62 has a detent 64 located thereon. Each detent 64 has a front cam surface 66 and a rear cam surface 68.

Figure 4:
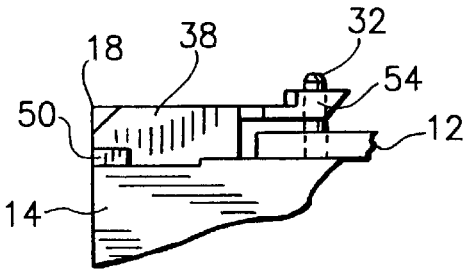
FIG. 4 is a partial side elevation view of the connector assembled with the vibration damper shown in FIG. 3.

The vibration damper 18 is attached to the upper surface 20 of the first connector 14. The vibration damper 18 is installed after the first connector 14 is connected to the printed circuit board 12. The vibration damper 18 is mounted between a pair of the guide rails 38 on upper surface 20 at the rear of the connector 14. The tongues 50 on the vibration damper 18 are inserted from the rear 36 of the first connector 14 forward into the complementing grooves 40 in the guide rails 38. The tongues 50 form a close friction fit with the mating grooves 40. The grooves 40 are located relative to the upper surface 20 of the first connector 14 and the tongues 50 are located relative to the lower seating surface 48 of the vibration reducer 18 to firmly seat the lower seating surface 48 on the upper surface 20 (see FIGS. 2 and 4). In the preferred embodiment, the grooves 40 are located at the interface 100 between the guide rails 38 and upper surface 20 of the first connector 14, as shown in FIG. 3. The tongues 50 are also located flush with the lower seating surface 48 of the vibration damper 18. By sizing the tongues 50 and grooves 40 to obtain a close fit therebetween, a firm seat between the lower seating surface 48 of the vibration damper 18 and the upper surface 20 of the connector 14 is insured. In alternate embodiments, the grooves 40 may be located at any suitable height on the guide rails. The tongues would be correspondingly located on the sides of the vibration damper to provide a firm contact between seating surfaces of the damper and connector. When the tongues 50 of the vibration damper 18 are being inserted into the grooves 40 the restraint arm 54 is deflected upward by the post. The boss section 56 is positioned over the post 32 on the first connector 14 and the arm 54 is lowered. The post 32 enters the hole 60 in the restraint arm 54. Thus the vibration damper 18 is longitudinally locked to the first connector 14.

Referring now to FIG. 1, the second connector 16 has male contacts 28. The second connector 16 comprises a mid-section 72 with a pair of stabilizers 74A, 74B extending therefrom. In the preferred embodiment, the mid-section 72 comprises a substantially flat vertical section 76 having a front face 78. The male contacts 28 project from the front face 78 of the mid-section 72 towards the front end 70 of the connector 16. In alternate embodiments, the mid-section may have any suitable shape. The stabilizers 74A, 74B cantilever forward from opposite ends 80 of the mid-section 72. The stabilizers 74A, 74B are located sufficiently far apart to admit therebetween a rear portion 82 of the first connector 14 with the vibration damper 18 (see FIG. 5). The upper stabilizer 74A has a pair of slots 84. The lower surface 86 of the upper stabilizer 74A has a recess 87 formed therein proximate the front 70 of the connector 16. Both stabilizers 74A, 74B have inward facing ramps 88A, 88B at the front 70 of the connector 16.

Figure 5:
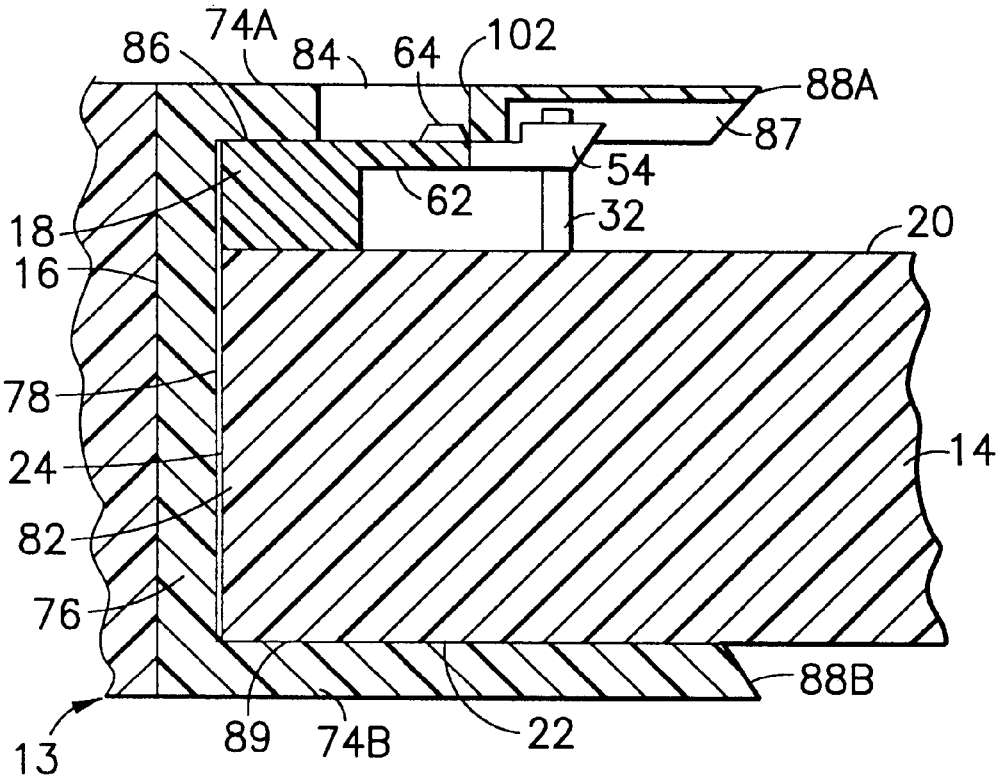
FIG. 5 is a cross-sectional elevation view of the printed circuit board assembly shown in FIG. 1.

Referring now to FIGS. 1 and 5, the second connector 16 is removably connected to the first connector 14 after the first connector 14 is mounted to the printed circuit board 12 and the vibration damper 18 is attached to the first connector 14. The second connector 16 is attached to another component 13, such as a second printed circuit board. The second connector 16 is slid, front end 70 first, over the rear end 36 of the first connector 14 until its rear surface 24 interfaces with the front face 78 of the second connector 16. The second connector 16 is laterally aligned relative to the first connector so that the bottom sides of the edges 90A, 90B of the upper stabilizer 74A of the second connector 16 ride on top of the corresponding guide rails 38 on the first connector 14. The ramps 88 on the upper and lower stabilizers 74A, 74B co-act with the guide rails 38 and the lower surface 22 of the first connector 14 to guide the rear portion 82 of the first connector 14 between the stabilizers 74A, 74B. Between the guide rails 38 the upper stabilizer 74A is supported by the block shaped section 42 of the vibration damper 18. The block shaped section 42 of the vibration damper 18 creates a friction connection between the first connector 14 and the second connector 16. The block shaped section 42 is sized so that, when the rear portion 82 of the first connector 14 is located between the stabilizers 74A, 74B of the second connector 16, the upper seating surface 46 of the vibration damper 18 contacts the lower surface 86 of the upper stabilizer 74A. The contact urges the second connector 16 upward so that the upper surface 89 of the lower stabilizer 74B is drawn against the lower surface 22 of the first connector 14. The stabilizers 74A, 74B of the second connector 16 generate compression forces against the rear portion 82 of the first connector 14. The vibration damper 18, with the rear portion 82, is sandwiched between the stabilizers 74A, 74B. The block shaped section 42 is seated firmly against the upper surface 20 of the first connector 14 without any clearance which may allow vertical movement between the vibration damper 18 and the upper surface 20 of the connector 14.

The vibration damper 18 provides a positive mechanical restraint to the second connector 16 when it is located over the first connector 14. The positive restraint is formed by the detents 64 of the vibration damper 18 engaging the slots 84 of the upper stabilizer 74A of the second connector 16. When locating the second connector 16 over the first connector 14, the top ramp 88A on the upper stabilizer 74A co-acts with the rear cam surfaces 68 on the detents 64 of the vibration damper 18 to resiliently deflect the cantilevers 62 downward. The detents 64 are snapped into the slots 84 in the upper stabilizer 74A when the front face 78 of the second connector 16 abuts the rear interface surface 24 of the first connector 14. With the detents 64 located in the slots 84, the detents 64 engage the front edges 102 of the slots to resist rearward movements of the second connector 16 relative to the first connector 14. Hence, a positive restraint is formed between the vibration damper 18 and the second connector 16. The front edges 102 of the slots 84 in the second connector 16 are located to minimize any longitudinal movement between the second connector 16 and the first connector 14. The detents 64 engage the front edges 102 of the slots 84 on the second connector 16 when the front face 78 of the second connector 16 abuts the rear interface surface 24 of the first connector 14. Forward movement of the second connector 16 relative to the first connector 14 is prevented by the abutting rear interface surface 24 of the first connector 18. Rearward movement of the second connector 16 relative to the first connector 14 is restrained by the detents 64 on the vibration damper 18. Movement of the vibration damper 18 relative to the first connector 14 is prevented by the restraint arm 54 of the vibration damper 18 which is anchored to post 32 on the first connector 14. The restraint against rearward movement of the second connector 16 relative to the first connector 14 provided by the vibration damper 18 is sufficient to prevent vibratory movement during shipment, but not enough to prevent intentional manual removal of the second connector 16 from the first connector 14.

Sufficient manual force may be applied to overcome the restraint between the second connector 16 and the assembly of the vibration damper 18 and the first connector 14. When applying adequate manual force to remove the second connector 16, the front edges 102 of the slots 84 in the upper stabilizer 74A ride upon the front cam surfaces 66 of the detents 64 located in the slots 84. This deflects the cantilevers 62 so the detents 64 exit the slots 84, and thus the second connector 16 may be removed. Because the front edges 102 of the slots 84 are substantially vertical and not parallel to the front cam surfaces 66 on the detents 64, substantial removal force must be applied to deflect the cantilevers 62 and overcome the connection between the second connector 16 and the first connector 14. The inertial forces caused by vibratory movements between the second connector 16 and the first connector 14 and the components connected thereto are not sufficient to dislocate the front edges 102 over the detents 64. The effect of the inertial forces on the connection between connectors 14, 16, is further minimized by the friction forces generated between the vibration damper 18 and the second connector 16 as well as between the contacts in the two connectors 14, 16.

The present invention abates vibratory movements between removably connected connectors within a printed circuit board assembly. Printed circuit board assemblies are commonly subjected to vibratory environments, either during shipping or when included in a component mounted on a vibrating platform. Vibratory environments cause vibratory movements between removably connected connectors such as the second connect or 16 and first connector 14 of the present invention. These vibratory movements, if left unabated , induce a ratcheting motion which tend to separate the connectors 14, 16 resulting in degradation of the electrical connection between connectors 14, 16 with the consequential loss of signal transmission. In the present invention the vibratory movements are abated by the friction forces and positive mechanical restraint provided by the vibration damper 18 sandwiched between the first connector 14 and the second connector 16. Hence, the quality of the electrical connection between the connectors 14, 16 is not adversely affected by even the most severe shipping vibrations. In the present invention the vibration damper 18 was attached to the upper side 20 of the first connector 14. In an alternate embodiment, the vibration damper may be attached to the lower side of the first connector or two vibration dampers may be used with each one being attached to an opposite side of the connector. In other alternate embodiments, the vibration damper may be attached to surfaces on the second connector to form a friction connection and engage stabilizer surfaces on the first connector.

It should be understood that the foregoing description is only illustrative of the invention. Various alternative and modifications can be devices by those skilled in the art without departing from the invention. Accordingly, the present invention is intended to embrace all such alternative, modifications and variances which fall within the scope of the appended claims.

What is claimed is:

1. A printed circuit board assembly comprising:

a printed circuit board;

a first connector directly mounted to the printed circuit board;

a second connector removably connected to the first connector; and a vibration damper between the first and second connectors, the vibration damper comprising the second connector having a pair of stabilizers located on opposite sides of the first connector and a shim block attached to the first connector wherein the shim block is sandwiched between a first one of the pair of stabilizers of the second connector and the first connector to provide a friction connection between the first connector and the pair of stabilizers on the second connector.

2. A printed circuit board assembly as in claim 1, wherein the shim block has a frame made from a dielectric material, the frame being a one-piece member.

3. A printed circuit board assembly as in claim 1, wherein the shim block has a lower seating surface and an upper seating surface, and wherein the lower seating surface is seated against the first connector and the upper seating surface is seated against the first one of the pair of stabilizers on the second connector when the shim block is sandwiched therebetween.

4. A printed circuit board assembly as in claim 3, wherein the upper seating surface of the shim block has a spring loaded detent to engage a locating surface on the first one of the pair of stabilizers on the second connector.

5. A printed circuit board assembly a in claim 4, wherein the upper seating surface of the shim block has two of the spring loaded detents the detents being located on two resilient flexible fingers cantilevered from the upper seating surface so that each detent is located on a corresponding one of the fingers.

6. A printed circuit board assembly as in claim 5, wherein each of the detents has a ramp section located to co-act with the first one of the pair of stabilizers on the second connector to deflect each of the fingers.

7. A printed circuit board assembly as in claim 3, wherein the shim block is sized to be admitted between a pair of stops projecting from a side of the first connector facing the lower seating surface of the shim block.

8. A printed circuit board assembly as in claim 7, wherein the shim block has a pair of tongues, projecting from opposite sides of the shim block and wherein each one of the pair of stops on the first connector has a groove formed therein adapted to receive a mating one of the pair of tongues when the shim block is located between the pair of stops on the first connector.

9. A printed circuit board assembly as in claim 2, wherein the shim block has an arm extending therefrom with a hole formed therein, the hole being adapted to admit a post projecting from the first connector.

10. A printed circuit board assembly comprising:

a printed circuit board;

a first connector mounted directly to the printed circuit board;

a second connector removably connected to the first connector, the second connector having a pair of guides projecting toward a front of the second connector and located on opposite sides of the first connector when the second connector is connected to the first connector; and a support block attached to the first connector between the first connector and second connector so that a support surface of the support block contacts a first one of the pair of guides;

wherein the support surface of the support block has a spring loaded portion located in the first one of the pair of guides.

11. A printed circuit board assembly as in claim 10, wherein the spring loaded portion of the support block comprises a resiliently flexible cantilever extending from the support block substantially parallel to the first one of the pair of guides on the second connector, the cantilever having a detent projecting from the cantilever toward the first one of the pair of guides.

12. A printed circuit board assembly as in claim 11, wherein the first one of the pair of guides on the second connector has a hole formed therein to admit the detent on the cantilever of the support block.

13. A printed circuit board assembly as in claim 12, wherein the support block has two of the cantilevers and two of the detents, and wherein the first one of the pair of guides on the second connector has two of the holes, each hole admitting a corresponding one of the detents.

14. A printed circuit board assembly as in claim 10, wherein the support block has a pair of tongues extending from opposite sides and the first connector has a pair of attachment walls projecting alongside the support block on opposite sides of the support block, wherein each attachment wall has a groove formed therein adapted to admit a corresponding one of the pair of tongues.

15. A printed circuit board assembly as in claim 10, wherein the support block has an arm cantilevered toward the front of the second connector and extending substantially parallel to the pair of guides of the second connector, the arm having a hole with a post projecting from the first connector located therein.

16. In a printed circuit board assembly comprising a printed circuit board, a first connector mounted directly to the printed circuit board and a second connector removably mounted to the first connector, wherein the improvement comprises;

a connector retainer attached to the first connector between the first connector and the second connector, the connector retainer having a general block shape with a lower seating surface seated on an upper side of the first connector and having a pair of tangs projecting from opposite sides of the block shape into the first connector.

17. A printed circuit board assembly as in claim 16, wherein the block shape has an upper seating surface that contacts a mating surface of the second connector located over the upper surface of the first connector.

18. A printed circuit board assembly as in claim 17 wherein the upper seating surface of the block shape has a spring loaded detent that engages a locating surface formed in the mating surface of the second connector.

19. A printed circuit board assembly as in claim 16, wherein the upper side of the first connector has a pair of locating surfaces projecting therefrom on opposite sides of the connector retainer, each of the locating surfaces having a groove conforming to a mating one of the pair of tangs on the connector retainer so that a close fit is formed when the tangs are located in the corresponding grooves.

20. A method for connecting a connector to a printed circuit board assembly comprising the steps of:

providing a printed circuit board assembly having a printed circuit board with a first connector mounted directly thereto;

attaching a vibration reducer to the first connector, the vibration reducer having a general block shape adapted to be admitted between a pair of guides projecting from a first side of the first connector; and removably connecting a second connector to the first connector, the second connector having a pair of cantilevered stabilizers located astride the first connector, a first one of the pair of stabilizers sandwiching the vibration reducer between the first connector and second connector to form a friction connection.

21. A method as in claim 20, wherein the step of attaching the vibration reducer comprises inserting a pair of tongues extending from opposite sides of the block shape into mating grooves formed in the pair of guides projecting from the first side of the first connector.

22. A method as in claim 20, wherein the step of attaching the vibration reducer comprises placing an arm cantilevered from the block shape and extending alongside the first side of the first connector, over a post projecting from the first side of the first connector, the arm having a hole to admit the post thereinto.

* * * * *